United States Patent [19]

Scheerer et al.

[11] Patent Number: 5,009,990

[45] Date of Patent: Apr. 23, 1991

[54] PHOTOGRAPHIC RECORDING MATERIAL

[75] Inventors: Rainer Scheerer, Cologne; Franz Moll, Leverkusen, both of Fed. Rep. of Germany

[73] Assignee: Agfa-Gevaert Aktiengesellschaft, Leverkusen, Fed. Rep. of Germany

[21] Appl. No.: 440,463

[22] Filed: Nov. 20, 1989

Related U.S. Application Data

[63] Continuation of Ser. No. 156,582, Feb. 16, 1988, abandoned.

[30] Foreign Application Priority Data

Feb. 26, 1987 [DE] Fed. Rep. of Germany ..... 3706199

[51] Int. Cl.[5] ..... G03C 1/30; G03C 1/34

[52] U.S. Cl. ..... 430/539; 430/614; 430/615; 430/621; 430/623

[58] Field of Search ..... 430/539, 614, 615, 621, 430/623, 951

[56] References Cited

U.S. PATENT DOCUMENTS

| | | | |
|---|---|---|---|
| 2,444,605 | 7/1948 | Heimbach et al. | 430/615 |
| 2,449,225 | 9/1948 | Heimbach et al. | 430/615 |
| 3,244,521 | 4/1966 | Dersch et al. | 430/615 |
| 3,573,056 | 3/1971 | Baldock et al. | 430/615 |
| 4,063,952 | 12/1977 | Himmelmann et al. | 430/623 |
| 4,369,248 | 1/1983 | Ranz et al. | 430/539 |
| 4,421,847 | 12/1983 | Jung et al. | 430/621 |
| 4,618,573 | 10/1986 | Okamura et al. | 430/621 |
| 4,727,017 | 2/1988 | Pollet et al. | 430/615 |

OTHER PUBLICATIONS

James, The Theory of the Photographic Process, 4th ed. 1977, pp. 398–399.

*Primary Examiner*—Charles L. Bowers, Jr.
*Assistant Examiner*—Mark R. Buscher
*Attorney, Agent, or Firm*—Connolly & Hutz

[57] ABSTRACT

A photographic recording material which has at least one silver halide emulsion layer containing gelatine, at least one protective layer and at least one hardening layer and in which the protective layer is further removed from the layer support than any silver halide emulsion layer and the hardening layer is further removed from the layer support than any other layer and contains an effective quantity of at least one instant hardener will have improved stability in storage under moist, warm conditions if the protective layer contains an effective quantity of at least one azaindene.

4 Claims, No Drawings

PHOTOGRAPHIC RECORDING MATERIAL

This application is a continuation of application Ser. No. 156,582, filed Feb. 16, 1988 now abandoned.

The present invention relates to a photographic recording material having at least one silver halide emulsion layer containing gelatine, in particular for black and white photography.

It is known to harden the layers of photographic recording materials and numerous classes of hardeners are available for this purpose. Instant hardeners, e.g. of the type described in DE-PS No. 22 25 230 and DE-PS No. 24 39 551, are particularly advantageous.

It is further known to stabilize silver halide emulsion layers by the addition of so called stabilizers in order to prevent fogging or to stabilize the photographic functions during production, storage or photographic processing. The azaindenes have proved to be a particularly effective class of compounds, e.g. triazaindenes, tetraazaindenes and pentaazaindenes.

Photographic materials in which the layers have been hardened with instant hardeners and the silver halide emulsion layer (s) have been stabilized with an azaindine nevertheless require to be improved as they have insufficient stability under conditions of moist, warm storage and regression of the latent image occurs, in particular in black and white negative materials.

It is an object of the present invention to overcome these disadvantages and obtain the advantages of instant hardeners, namely instant hardening, high mechanical strength and avoidance of reticulation.

This problem is solved by providing the photographic recording material with a protective layer which is further removed from the layer support than any silver halide emulsion layer and contains an azaindine in effective quantity.

The present invention thus relates to a photographic recording material having at least one silver halide emulsion layer containing gelatine, at least one protective layer and at least one hardening layer, in which the protective layer is further removed from the layer support than any silver halide emulsion layer and the hardening layer is further removed from the layer support than any other layer and contains an effective quantity of at least one instant hardener, characterized in that the protective layer contains at least one azaindine in effective quantity.

The silver halide emulsion layer preferably also contains an azaindine as stabilizer in the optimum quantity, which is normally from 5 to 50 mg/m$^2$.

The quantity of azaindene in the protective layer is used in addition to the optimum quantity in the emulsion layer. The layers may contain the same azaindene or different azaindenes.

The photographic recording materials may be colour negative films, colour reversal films, colour positive films, colour photographic paper, colour reversal photographic paper, colour sensitive materials for the dye diffusion transfer process or for a silver dye bleaching process and black and white light sensitive materials such as black and white films, X-ray films, process films, black and white photographic paper, films for aerial photographs, micro films, facsimile films, films and photographic paper for photo compositions, films for graphic work etc.

The advantage obtainable is particularly marked for black and white negative films.

Instant hardeners are compounds which crosslink suitable binders at such a rate that hardening has been completed to such a stage immediately after casting or at the latest after 24 hours, preferably after 8 hours, that no further change in the sensitometry or in the swelling of the layer unit occurs as a result of the crosslinking reaction. By "swelling" is meant the difference between the wet layer thickness and the dry layer thickness of a film undergoing aqueous processing (Photogr. Sci. Eng. 8 (1964), 275; Photogr. Sci. Eng. 16 (1972), 449).

These hardening agents which react very rapidly with gelatine include, for example, carbamoyl pyridinium salts which presumably are capable of reacting with free carboxyl groups of the proteinaceous binder so that the latter are capable of reacting with free amino groups with the formation of peptide bonds and crosslinking of the binder.

Suitable examples of instant hardeners include compounds corresponding to the following general formulae:

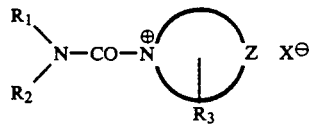

(a)

wherein $R_1$ denotes alkyl, aryl or aralkyl, $R_2$ has the same meaning as $R_1$ or denotes alkylene, arylene, aralkylene or alkaralkylene and the second bond is linked to a group corresponding to the formula

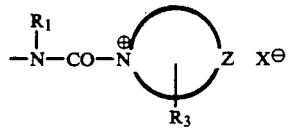

or $R_1$ and $R_2$ together represent the atoms required for completing an optionally substituted heterocyclic ring, for example a piperidine, piperazine or morpholine ring, which ring may be substituted, e.g. by $C_1$ to $C_3$ alkyl or by halogen, $R_3$ denotes hydrogen, alkyl, aryl, alkoxy, $—NR_4—COR_5$, $—(CH_2)_m—NR_8R_9$, $—(CH_2)_n—CONR_{13}R_{14}$ or

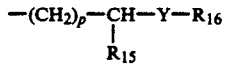

or a bridging member or a direct link to a polymer chain, and $R_4$, $R_6$, $R_7$, $R_9$, $R_{14}$, $R_{15}$, $R_{17}$, $R_{18}$, and $R_{19}$ denote hydrogen or $C_1$ to $C_4$ alkyl, $R_5$ denotes hydrogen, $C_1$ to $C_4$ alkyl or $NR_6R_7$, $R_8$ denotes $—COR_{10}$ $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$–$C_4$ alkyl or aryl, in particular phenyl, $R_{16}$ denotes hydrogen, $C_1$–$C_4$ alkyl, $COR_{18}$ or $CONHR_{19}$, m represents a number with a value from 1 to 3,
n represents a number with a value from 0 to 3,
p represents a number with a value from 2 to 3, and
Y denotes 0 or $NR_{17}$, or $R_{13}$ and $R_{14}$ together represent the atoms required for completing an optionally substituted heterocyclic ring, for example a piperidine, piperazine or morpholine ring, which ring may be substituted, e.g. by $C_1$–$C_3$-alkyl or by halogen, Z represents the carbon atoms required for completing a 5- or 6-membered aromatic heterocyclic ring, optionally with condensed benzene ring, and $X^{\ominus}$ denotes an anion, which is absent if an anionic group is already attached to the remainder of the molecule.

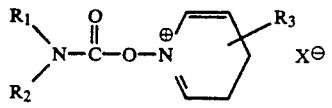

(b)

wherein $R_1$, $R_2$, $R_3$ and $X^{\ominus}$ have the meanings indicated for formula (a);

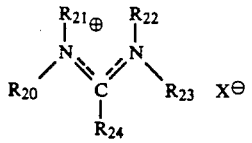

(c)

wherein $R_{20}$, $R_{21}$, $R_{22}$ and $R_{23}$ denote $C_1$–$C_{20}$ alkyl, $C_6$–$C_{20}$ aralkyl, or $C_5$–$C_{20}$ aryl, each of which may be unsubstituted or substituted by halogen, sulpho, $C_1$–$C_{20}$ alkoxy, or N,N-Di-$C_1$–$C_4$-alkyl substituted carbamoyl, and in the case of aralkyl and aryl, these may be substituted by $C_1$–$C_{20}$ alkyl, $R_{24}$ denotes a group capable of being split off by a nucleophilic agent, and $X^{\ominus}$ has the meaning indicated for formula (a), in which formula, 2 or 4 of the substituents $R_{20}$, $R_{21}$, $R_{22}$ and $R_{23}$ together with a nitrogen atom or the group

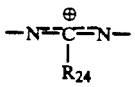

may also be joined together to form one or two saturated 5–7-membered rings, optionally with the inclusion of further hetero atoms such as O or N;

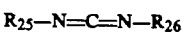

(d)

wherein $R_{25}$ denotes $C_1$–$C_{10}$ alkyl, $C_5$–$C_8$ cycloalkyl, $C_3$–$C_{10}$ alkoxy alkyl or $C_7$–$C_{15}$ aralkyl, $R_{26}$ has the meaning indicated for $R_{25}$ or represents a group of the formula

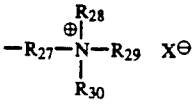

wherein $R_{27}$ denotes $C_2$–$C_4$ alkylene and $R_{28}$, $R_{29}$ and $R_{30}$ denote $C_1$–$C_6$ alkyl, and one of the groups $R_{28}$, $R_{29}$ and $R_{30}$ may be substituted by a carbamoyl group or a sulpho group and two of the groups, $R_{28}$, $R_{29}$ and $R_{30}$ together with the nitrogen atom may be joined together to form an optionally substituted heterocyclic ring, for example a pyrrolidine, piperazine or morpholine ring, which ring may be substituted, e.g. by $C_1$–$C_3$ alkyl or by halogen, and $X^{\ominus}$ has the meanings indicated for formula (a);

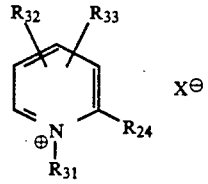

(e)

wherein $X^-$ has the meanings indicated for formula (a), $R_{24}$ has the meanings indicated for formula (c), $R_{31}$ denotes $C_1$–$C_{10}$ alkyl, $C_6$–$C_{15}$ aryl or $C_7$–$C_{15}$ aralkyl, each of which may be unsubstituted or substituted by carbamoyl, sulphamoyl or sulpho, $R_{32}$ and $R_{33}$ denote hydrogen, halogen, acylamino, nitro, carbamoyl, ureido, alkoxy, alkyl, alkenyl, aryl or aralkyl or together they may denote the remaining members of a ring condensed with the pyridinium ring, in particular a benzo ring, and $R_{24}$ and $R_{31}$ may be linked together when $R_{24}$ is a sulphonyl oxy group;

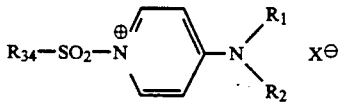

(f)

wherein $R_1$, $R_2$ and $X^-$ have the meanings indicated for formula (a) and $R_{34}$ denotes $C_1$–$C_{10}$ alkyl, $C_6$–$C_{14}$ aryl or $C_7$–$C_{15}$ aralkyl;

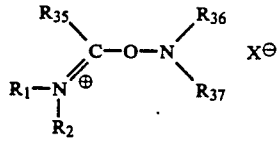

(g)

wherein $R_1$, $R_2$ and $X^{\ominus}$ have the meanings indicated for formula (a), $R_{35}$ denotes hydrogen, alkyl, aralkyl, aryl, alkenyl, $R_{38}O$, $R_{39}R_{40}N$, $R_{41}R_{42}C{=}N$ or $R_{38}S$, $R_{36}$ and $R_{37}$ denote alkyl, aralkyl, aryl, alkenyl,

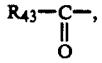

$R_{44}$—$SO_2$ or $R_{45}$—N=N or together with the nitrogen atom they represent the remaining members of a heterocyclic ring or they represent the group

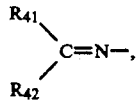

and $R_{38}$, $R_{39}$, $R_{40}$, $R_{41}$, $R_{42}$, $R_{43}$, $R_{44}$ and $R_{45}$ denote alkyl, aralkyl, alkenyl; and $R_{41}$ and $R_{42}$ may in addition denote hydrogen; $R_{39}$ and $R_{40}$ together and $R_{41}$ and $R_{42}$ may represent the remaining members of a 5- or 6-membered, saturated carbocyclic or heterocyclic ring;

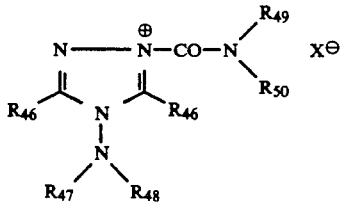

(h)

wherein $R_{46}$ denotes hydrogen, alkyl or aryl, $R_{47}$ denotes acyl, carbalkoxy, carbamoyl or aryloxy carbonyl;

$R_{48}$ denotes hydrogen or $R_{47}$ $R_{49}$ and $R_{50}$ denote alkyl, aryl, or aralkyl; or together with the nitrogen atom they represent the remaining members of an optionally substituted heterocyclic ring, for example a piperidine, piperazine or morpholine ring, which ring may be substituted, e.g. by $C_1$–$C_3$ alkyl or halogen, and $X^{\ominus}$ has the meanings indicated for formula (a);

$$R_{51}[SO_2-CH=CH_2]_q \quad (i)$$

wherein $R_{51}$ denotes an optionally substituted heteroaromatic ring, containing at least q ring carbon atoms and at least one ring O, ring S or Ring N atom, and q represents an interger $\geqq 2$.

The heteroaromatic ring represented by $R_{51}$ may be, for example, a triazole, thiadiazole, oxadiazole, pyridine, pyrrole, quinoxaline, thiophene, furan, pyrimidine, or triazine ring. In addition to the at least 2 vinyl sulphonyl groups it may contain other substituents and optionally condensed benzene rings which may in turn be substituted. Examples of heteroaromatic rings ($R_{51}$) are shown below.

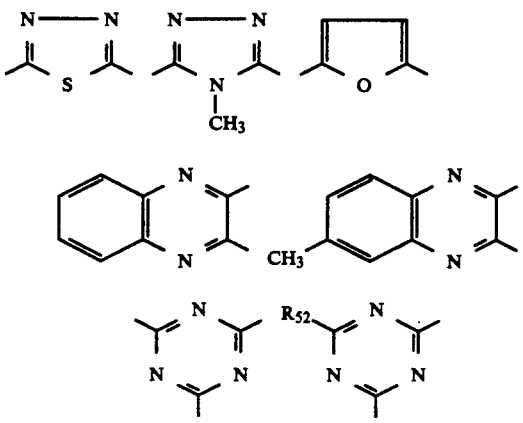

-continued

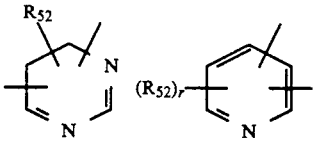

wherein r represents a number with a value from 0 to 3 and $R_{52}$ denotes $C_1$–$C_4$ alkyl, $C_1$–$C_4$ alkoxy or phenyl.

Suitable instant hardeners also include the compounds described in Japanese Offenlegungsschriften Nos. 38 540/75, 93 470/77, 43 353/81 and 113 929/83 and in U.S. Pat. No. 3,321,313.

Alkyl denotes in particular a $C_1$–$C_{20}$ alkyl optionally substituted by halogen, hydroxy, sulpho or $C_1$–$C_{20}$ alkoxy, unless defined differently.

Aryl, unless defined differently, denotes in particular a $C_6$–$C_{14}$ aryl, optionally substituted by halogen, sulpho, $C_1$–$C_{20}$ alkoxy, or $C_1$–$C_{20}$ alkyl. Aryl, unless defined differently, denotes in particular a $C_7$–$C_{20}$ aralkyl substituted by halogen, $C_1$–$C_{20}$ alkoxy, sulpho or $C_1$–$C_{20}$ alkyl. Alkoxy denotes in particular $C_1$–$C_{20}$ alkoxy, unless defined differently.

$X^{\ominus}$ is preferably a halide ion, such as $Cl^{\ominus}$, $Br^{\ominus}$ or $BF_4^{\ominus}$ $NO_3^{\ominus}$, $(SO_4^{2\ominus})_{\frac{1}{2}}$, $ClO_4^{\ominus}$, $CH_3OSO_3^{\ominus}$, $PF_6^{\ominus}$, or $CF_3SO_3^{\ominus}$.

Alkenyl denotes in particular a $C_2$–$C_{20}$ alkenyl. Alkylene denotes in particular a $C_2$–$C_{20}$ alkylene; arylene denotes in particular phenylene; aralkylene denotes in particular benzylene and alkaralkylene denotes in particular xylylene.

Suitable N-containing ring sytems for which Z may stand are shown on the previous page. The pyridine ring is preferred.

$R_{36}$ and $R_{37}$ together with the nitrogen atoms to which they are attached form in particular a pyrrolidine or piperidine ring which is substituted by two oxo groups attached in the o- and o'-position and may be benzo-, cyclohexeno- or (2,2,1)-bicyclohexeno condensed.

Acyl is in particular $C_1$–$C_{10}$ alkyl carbonyl or benzoyl; carbalkoxy is in particular $C_1$–$C_{10}$ alkoxycarbonyl; carbamoyl is in particular mono- or di-$C_1$–$C_4$-alkyl amino carbonyl; carbaroxy is in particular phenoxycarbonyl.

Groups 24 capable of being split off by nucleophilic agents include, for example, halogen atoms, $C_1$–$C_{15}$ alkyl sulphonyloxy groups, $C_7$–$C_{15}$ aralkyl sulphonyloxy groups, $C_6$–$C_{15}$ aryl sulphonyloxy groups and 1-pyridinyl groups.

Compounds corresponding to the following general formulae I–IV are suitable azaindenes:

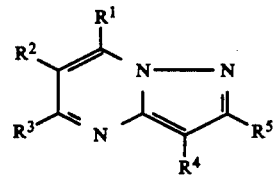

I

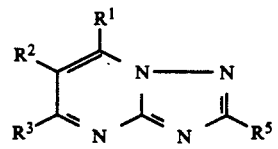

II

-continued

III

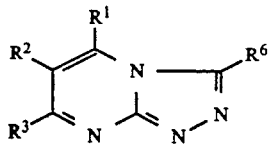

IV

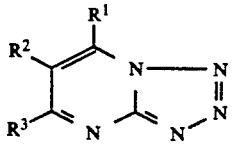

wherein $R^1$–$R^6$ denote H, OH, an optionally substituted alkyl group with 1–10 carbon atoms, such as methyl, ethyl, isopropyl, hydroxymethyl, carboxymethyl, or methylthiomethyl; an alkenyl group such as vinyl or allyl; an aralkyl group such as benzyl, an aryl group such as phenyl, methoxyphenyl, or chlorophenyl; an alkylthio group such as phenylthio; an alkoxy group such as methoxy; an amino group such as methylamino or diethylamino; halogen such as fluorine, chlorine, bromine or iodine; cyano, carboxy, alkoxycarbonyl, or aminocarbonyl. The groups $R^1$ and $R^2$ together or $R^2$ and $R^3$ together may form a 5- or 6-membered ring and at least one of the substituents $R^1$ or $R^3$ is a hydroxyl group.

1.

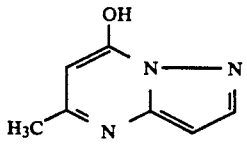

2.

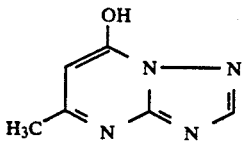

3.

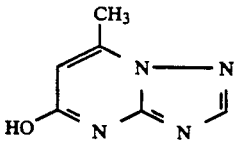

4.

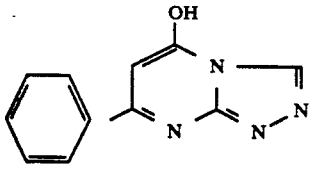

5.

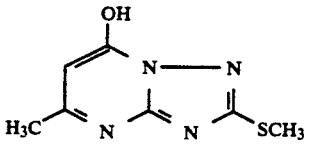

6.

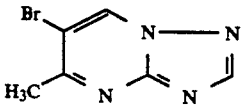

-continued

7.

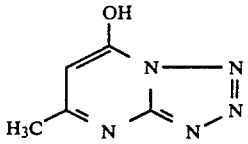

8.

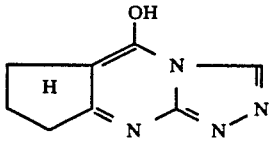

9.

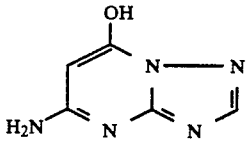

10.

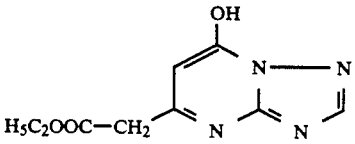

11.

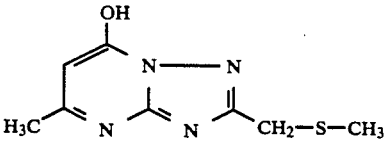

12.

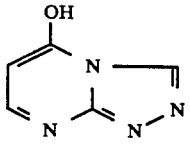

13.

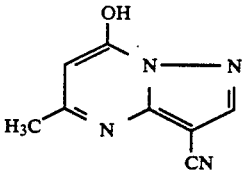

14.

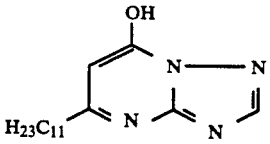

15.

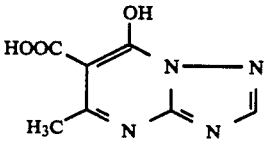

16.

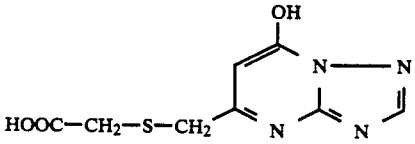

17.

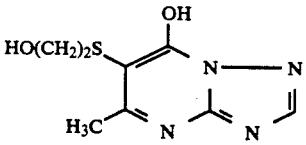

-continued

18.

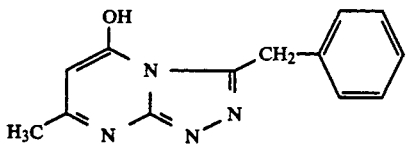

The compounds are known and may easily be prepared by the methods described in Ber. 42, 4638 (1907), ibid. 43 375 (1908), J. Chem. Soc. 1957, 727 or J. Org. Chem. 24, 787 (1959).

The light sensitive silver halide emulsions used may be emulsions of silver chloride, silver bromide or mixtures thereof, optionally with a small silver iodide content of up to 12 mol %, in gelatine which may, however, be partly replaced by other natural or synthetic binders.

Emulsions for colour photographic recording materials may be chemically and spectrally sensitized in the conventional manner.

Colour photographic recording materials conventionally contain at least one silver halide emulsion layer each for the recording of light from the three spectral regions, red, green and blue respectively. For this purpose, the light sensitive layers are spectrally sensitized in known manner by means of suitable sensitizing dyes. Blue sensitive silver halide emulsion layers need not necessarily contain a spectral sensitizer since the intrinsic sensitivity of the silver halide is in many cases sufficient for recording blue light.

Each of the light sensitive layers mentioned may consist of a single layer or it may be composed in known manner of two or more silver halide emulsion partial layers, e.g. as in the so called double layer arrangement (DE-C-1 121 470). Red sensitive silver halide emulsion layers are conventionally arranged closer to the layers support than green sensitive silver halide emulsion layers, which in turn are arranged closer to the support than blue sensitive layers, and a light insensitive yellow filter layer is generally placed between the green sensitive layers and the blue sensitive layers. Other arrangements could conceivably also be used. A light insensitive interlayer which may contain means for preventing accidental diffusion of developer oxidation products is generally arranged between the layers of differing spectral sensitivities. When several silver halide emulsion layers of the same spectral sensitivity are present, these may be directly adjacent to one another or they may be so arranged that a light sensitive layer of a different spectral sensitivity is situated between them (DE-A-1 958 709, DE-A-2 530 645, and DE-A-2 622 922).

Colour photographic recording materials for the production of multi colour images normally contain colour producing compounds, in this case particularly colour couplers, in spatial and spectral association to the silver halide emulsion layers to produce the different partial colour images in cyan, magenta and yellow.

By "spatial association" is meant that the colour coupler is in such a spatial relationship to the silver halide emulsion layer that they are capable of interacting to result in an imagewise correspondence between the silver image formed on development and the colour image produced from the colour coupler. This is generally achieved by arranging the colour coupler in the silver halide emulsion layer itself or in an optionally light insensitive layer of binder adjacent thereto.

By "spectral association" is meant that the spectral sensitivity of each of the light sensitive silver halide emulsion layers and the colour of the partial colour image produced from the colour coupler spatially associated therewith are in a certain relationship to one another, a different colour of the partial colour image (e.g. cyan, magenta, yellow) being associated with each of the spectral sensitivities (red, green, blue).

Each of the silver halide emulsion layers which are sensitized to different regions of the spectrum may have one or more colour couplers associated therewith. When several silver halide emulsion layers of the same spectral sensitivity are provided, each of these layers may contain a colour coupler and these colour couplers need not necessarily be identical, provided only that on colour development they give rise to at least approximately the same colour, normally a colour which is complementary to the colour of the light to which the particular silver halide emulsion layers are predominantly sensitive.

In preferred embodiments, therefore, red sensitive silver halide emulsion layers have at least one non-diffusible colour coupler associated therewith for the production of the cyan partial colour image, generally a coupler of the phenol or $\alpha$-naphthol series. Green sensitive silver halide emulsion layers have at least one non diffusible colour coupler associated therewith for producing the magenta partial colour image, conventionally a colour coupler of the 5-pyrazolone, indazolone or pyrazolotriazole series. Blue sensitive silver halide emulsion layers, lastly, have at least one non diffusible colour coupler associated therewith for producing the yellow partial colour image, generally a colour coupler containing an open chain ketomethylene group. Colour couplers of this type are known in large numbers and have been described in numerous Patent specifications.

The colour couplers may be incorporated in the casting solution of the silver halide emulsion layers or other colloid layers in known manner. For example, the oil soluble or hydrophobic couplers may advantageously be added to a hydrophilic colloid solution from a solution in a suitable coupler solvent (oil former), optionally in the presence of a wetting or dispersing agent. The hydrophilic casting solution may, of course, contain conventional additives in addition to the binder. The solution of the coupler need not be directly dispersed in the casting solution for the silver halide emulsion layer or other water permeable layer but may advantageously first be dispersed in an aqueous, light insensitive solution of a hydrophilic colloid and the resulting mixture may then be mixed with the casting solution for the light sensitive silver halide emulsion layer or another water permeable layer, optionally after removal of the low boiling organic solvent used, and may then be applied.

In addition to the constituents mentioned above, the colour photographic recording material may contain further additives such as anti-oxidants, dye stabilizing agents and substances for influencing the mechanical and electro static properties. It is advantageous to use UV-absorbent compounds in one or more of the layers of the recording material, preferably one of the upper layers, to reduce or prevent the damaging effect of UV light on the colour images produced with the colour photographic recording material according to the invention. Suitable UV absorbents have been described, for example, in U.S. Pat. No. 3,253,921, DE-C-2 036 719 and EP-A-0 057 160.

For the production of colour photographic images, the colour photographic recording material according to the invention is developed with a colour developer compound. Any developer compounds which are capable in the form of their oxidation product of reacting with colour couplers to form azomethine dyes may be used as colour developer compounds. Suitable colour developer compounds include aromatic compounds of the p-phenylene diamine series containing at least one primary amino group, for example, N,N-dialkyl-p-phenylene diamines such as N,N-diethyl-p-phenylenediamine, 1-(N-ethyl-N-methyl-sulphonamidoethyl)-3-methyl-p-phenylenediamine, 1-(N-ethyl-N-hydroxyethyl)-3-methyl-p-phenylene diamine and 1-(N-ethyl-N-methoxyethyl)-3-methyl-p-phenylene diamine.

After colour development, the material is normally bleached and fixed. Bleaching and fixing may be carried out separately or together. The usual bleaching compounds may be used, e.g. $Fe^{3+}$ salts and $Fe^{3+}$ complex salts, such as ferricyanides, dichromates, water soluble cobalt complexes, etc. Iron-III complexes of amino polycarboxylic acids, in particular, for example, of ethylene diamino tetracetic acid, N-hydroxyethyl ethylene diaminotriacetic acid, alkyl imino dicarboxylic acids and corresponding phosphonic acids are particularly preferred. Persulphates are also suitable bleaching agents.

The black and white materials according to this invention contain light sensitive silver halide in a quantity, calculated as $AgNO_3$, of from 1.5–15 g $AgNO_3/m^2$.

From 1–12 mol % of the bromide may be replaced by silver iodide. From 2 to 10% by weight of an internally fogged emulsion may be added to the emulsion. The emulsion is spectrally sensitized for the 400–650 nm region. The emulsion may contain an azaindene, known stabilizers such as α-naphthol sulphonic acid and polyalkylene oxides as development accelerators.

The auxiliary layer according to the invention contains azaindene in a quantity of from 20 to 300 mg/m². It may also contain known matting agents.

The instant hardener is used in a quantity corresponding to from 2 to 4% by weight of all the gelatine present over the layer support.

EXAMPLE 1

A silver halide emulsion was applied as layer A in a quantity of 6 g/m² to a cellulose triacetate film 0.13 mm in thickness.

The grains of the emulsion had an average diameter of 0.6 μm; the emulsion was an iodobromide emulsion containing 6 mol % of silver iodide. The emulsion contained equal parts by weight of silver halide and gelatine and was chemically sensitized by the addition of sulphur and gold compounds and spectrally sensitized to the region of 400 to 650 nm by means of the sensitizer corresponding to the formula.

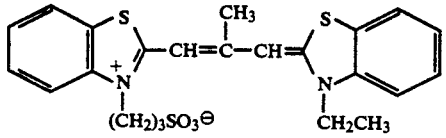

The emulsion layer contained 200 mg of 4-hydroxy-6-methyl-1,3,3A,7-tetraazaindene (12 mg/m²), 100 mg of α-naphtol sulphonic acid and 500 mg of polyalkylene oxide of average molecular weight 1500 to 100 g of silver halide.

A layer B having the following composition was cast on layer A:

Gelatine: 1.6 g/m²
$SrSO_4$: 70 mg/m²
Formaldehyde: 50 mg/m²

EXAMPLE 2

Layer A

As in Example 1.

Layer B

Gelatine: 1.6 g/m²
$SrSO_4$: 70 mg/m²

Layer C 300 mg of the instant hardener corresponding to the formula

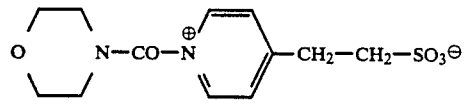

EXAMPLE 3

Layer A

As in Example 1 but with 112 mg/m² of tetraazaindene Nr. 2.

Layer B

As in Example 2.

Layer C

As in Example 2.

EXAMPLE 4

Layer A

As in Example 1.

Layer B

Gelatine: 1.6 g/m²
$SrSO_4$: 70 mg/m²
Tetraazaindene number 2: 100 mg/m²

Layer C

As in Example 2.

Development of the exposed photographic films was carried out for 7 minutes at 20° C. in the following developer:

Hydroquinone: 6 g/l
Metol: 2 g/l
Na-sulphite: 40 g/l
Na-tetraborate: 10 g/l
KBr: 3 g/l Fixing was carried out in a conventional sodium thiosulphate solution.

Development and assessment were carried out according to the following scheme:

Exposure and development after casting (I) Exposure after casting, development after 7 days storage at 35° C. and 90% relative humidity (II) Exposure and development after 7 days storage at 35° C. and 90% relative humidity (III).

The relative sensitivity ($E_{rel}$) and fog (S) as well as reticulation formation and resistance to mechanical stress were determined.

| Experiment | I | | II | | III | |
|---|---|---|---|---|---|---|
| | $E_{rel}$ | S | $E_{rel}$ | S | $E_{rel}$ | S |
| 1 | 100 | 0.11 | 85 | 0.15 | 80 | 0.15 |
| 2 | 100 | 0.10 | 70 | 0.13 | 70 | 0.13 |
| 3 | 80 | 0.16 | 75 | 0.19 | 70 | 0.19 |
| 4 | 105 | 0.10 | 90 | 0.12 | 90 | 0.13 |

In contrast to Example 1, Examples 2 to 4 form no reticulation after development at 38° C. and drying and, again in contrast to Example 1, even at this temperature they have excellent resistance to mechanical stress which produces scratches in Example 1.

Example 4 according to the invention shows improved storage stability of the image under moist, warm conditions, in contrast to Example 2.

This cannot be attributed to the increase in the total quantity of tetraazaindene since, if the total quantity of tetraazaindene is used exclusively in the emulsion layer, a drastic fall in sensitivity and drastic increase in fogging result (Example 3).

We claim:

1. Photographic black and white negative film having on a layer support at least one silver halide emulsion layer containing gelatine, at least one protective layer and at least one hardening layer, in which the protective layer is further removed from the layer support than any silver halide emulsion layer and the hardening layer is further removed from the layer support than any other layer and contains an effective quantity of at least one instant hardener, characterized in that the protective layer contains an effective quantity of 4-hydroxy-6-methyl-1,3,3a,7-tetraazaindene.

2. Photographic recording material according to claim 1, characterized in that the emulsion layer also contains an azaindene in optimum quantity.

3. Photographic recording material according to claim 1, characterized in that the hardener corresponds to the formula

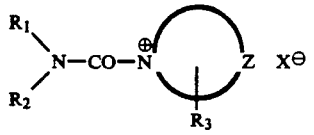

(a)

wherein $R_1$ denotes alkyl, aryl or aralkyl, $R_2$ has the same meaning as $R_1$ or denotes alkylene, arylene, aralkylene or alkaralkylene, in which the second bond is linked to a group of the formula

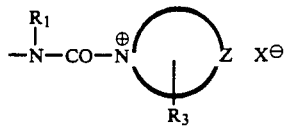

or $R_1$ and $R_2$ together denote the atoms required for completing an optionally substituted heterocyclic ring, for example a piperidine, piperazine, or morpholine ring, which ring may be substituted, for example by $C_1$–$C_3$ alkyl or by halogen, $R_3$ denotes hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or a bridging member or a direct link to a polymer chain, and $R_4$, $R_6$, $R_7$, $R_9$, $R_{14}$, $R_{15}$, $R_{17}$, $R_{18}$ and $R_{19}$ denote hydrogen or $C_1$–$C_4$ alkyl, $R_5$ denotes hydrogen, $C_1$–$C_4$ alkyl or $NR_6R_7$, $R_8$ denotes $COR_{10}$ $R_{10}$ denotes $NR_{11}R_{12}$ $R_{11}$ denotes $C_1$–$C_4$ alkyl or aryl, in particular phenyl, $R_{12}$ denotes hydrogen, $C_1$–$C_4$ alkyl or aryl, in particular phenyl, $R_{13}$ denotes hydrogen, $C_1$–$C_4$ alkyl or aryl, in particular phenyl, $R_{16}$ denotes hydrogen, $C_1$–$C_4$ alkyl, $COR_{18}$ or $CONHR_{19}$, m denotes a number from 1 to 3 n denotes a number from 0 to 3, p denotes a number from 2 to 3 and

Y denotes 0 or $NR_{17}$ or $R_{13}$ and $R_{14}$ together represent the atoms required for completing an optionally substituted heterocyclic ring, for example a piperidine, piperazine or morpholine ring, which ring may be substituted, e.g. by $C_1$–$C_3$ alkyl or halogen, Z denotes the carbon atoms required for completing a 5- or 6-membered aromatic heterocyclic ring, optionally with condensed benzene ring, and $X^{\ominus}$ denotes an anion, which is absent if an anionic group is already linked to the remaining molecule.

4. Photographic recording material according to claim 1, characterized in that the protective layer contains from 20–300 mg/m² of azaindene, the emulsion layer contains from 5–50 mg/m² of azaindene and the hardening layer contains from 2 to 4% by weight of instant hardener, based on the total quantity of gelatine present above the layer support.

* * * * *